US006151797A

United States Patent [19]

Fleissner

[11] Patent Number: 6,151,797

[45] Date of Patent: Nov. 28, 2000

[54] DEVICE FOR HEAT TREATMENT OF PERMEABLE WEBS OF GOODS

[75] Inventor: Gerold Fleissner, Zug, Germany

[73] Assignee: Fleissner GmbH & Co., Maschinenfabrik, Egelsbach, Germany

[21] Appl. No.: 09/302,441

[22] Filed: Apr. 30, 1999

[30] Foreign Application Priority Data

Apr. 30, 1998 [DE] Germany ..... 198 19 340

[51] Int. Cl.[7] ..... D06F 58/00

[52] U.S. Cl. ..... 34/115; 34/120; 34/122

[58] Field of Search ..... 34/568, 110, 114, 34/115, 120, 122, 125; 26/74, 75, 76; 68/5 D, 158, 903

[56] References Cited

U.S. PATENT DOCUMENTS

| | | | |
|---|---|---|---|
| 5,031,338 | 7/1991 | Wedel | 34/115 |
| 5,371,954 | 12/1994 | Pinter et al. | 34/115 |
| 5,443,540 | 8/1995 | Kamikawa | 34/78 X |
| 5,465,502 | 11/1995 | Holik et al. | 34/115 |
| 5,520,744 | 5/1996 | Fujikawa et al. | 134/11 |
| 5,542,192 | 8/1996 | Deshpande et al. | 34/115 |
| 5,546,675 | 8/1996 | McGraw et al. | 34/115 X |
| 5,864,963 | 2/1999 | Komulainen | 34/125 X |

*Primary Examiner*—Stephen Gravini

*Attorney, Agent, or Firm*—Antonelli,Terry, Stout & Kraus, LLP

[57] ABSTRACT

A device is known for heat treatment of permeable webs of goods with a housing in which at least one screen roller is mounted and a pumping device is associated endwise with the roller, said pumping device drawing a processing medium in the formal of a vapor and/or gas out of the screen roller, with the through-flow area of the roller, in other words the working width of the screen roller, being capable of being determined by a width-adjusting device on the screen roller. A screen roller of this kind is improved according to the invention if a) at least in the area covered by the web of goods, it has two coaxially mounted permeable screen roller jackets located with a distance between them, b) a width-adjusting device is provided between the outer and inner screen roller jackets, said device c) being adjustable by a spindle on the axis of the screen roller, and d) the inner screen roller jacket is made permeable only in the area that corresponds to the minimum working width of the roller.

A design of this kind is suitable for large differences in working width and also for smaller screen roller diameters without resulting in non-uniform processing over the working width.

16 Claims, 2 Drawing Sheets

DEVICE FOR HEAT TREATMENT OF PERMEABLE WEBS OF GOODS

BACKGROUND OF THE INVENTION

The device relates to a device for heat treatment of permeable webs of goods, especially textiles such as fabrics, warp knits, tissues, fleeces, and the like, with a housing in which at least one screen roller is mounted and a pumping device is associated endwise with the screen roller, said pumping device drawing a processing medium in the form of a vapor and/or gas out of the screen roller. The through-flow area, in other words the working width of the screen roller, can be determined by a width-adjusting device at the screen roller and a screen lid or a fixed cylindrical body in the form of a screen are located externally relative to the screen roller to even out the flow.

A device of this kind is shown in DE-A 19 00 496. In that document, the screen lid for evening out the through air flow over the length of the screen roller is also disclosed. Normally the screen lid is permeable to air over the entire length of the screen roller, but in this case this is only true in the middle area because a working width adjustment is provided in the middle of the roller. For this purpose, the screen roller surrounds an additional wall that extends up to the screen lid. The wall is axially adjustable by several spindles located around the roller. In order to avoid "false air" —in other words, air that does not flow through the web of goods to be processed but instead flows directly through the uncovered roller area straight to the fan—with a small working width setting, the screen lid is therefore permeable to air only in the middle area. A width-adjusting device of this kind is very costly, if only because of the many drive spindles that must be provided around the roller. In addition, this design is less suitable for wide webs of goods because the processing air for the marginal areas of the web must flow from the middle of the screen lid, which is the only permeable part, to these marginal areas. It is not possible to expose the screen roller uniformly to processing air over the width of the web of goods.

The design according to DE-A 19 26 742 is advantageous in this regard. In that document, a screen roller is disclosed that consists of two axially arranged screen roller jackets mounted with a distance between them. This design has the advantage that the second, inner screen roller jacket can be used as an additional blocking element. This is particularly true if the permeability of the inner jacket to air is less than that of the outer screen roller jacket. In this document, an outer screen lid is also disclosed so that the air entering from a fan is initially blocked at this lid over the length of the roller, and is therefore evened out. Then it flows uniformly over any working width through the goods on the roller and is blocked again by the second inner jacket, which not only permits more uniform processing over the working width but even makes a mechanical width adjustment superfluous because the permeability of the roller is reduced overall. However, this is effective only in the area of the roller that is free of the web since the textile itself generally offers a greater resistance to the passage of the air than the double jacket. In order to avoid "false air" —air flowing axially between the jackets—here as well, fixed panels are provided in the outer area of the roller and extend radially between the jackets around the roller.

The solution according to DE-A 19 26 742, without a mechanical width adjustment, is viewed as a compromise. Especially for larger working widths, and therefore long screen rollers, and larger different working widths, this design is not satisfactory in terms of its drying ability.

SUMMARY OF THE INVENTION

The goal of the invention is to find a screen roller design that combines the advantages of the two previously known designs but avoids their disadvantages. Therefore, a design is desired which ensures a uniform through flow of air through the widest web of goods but also can be adjusted optimally for a narrower width of the web without a design being required that is as expensive as in DE-A 19 00 496.

Taking its departure from the design of the species recited at the outset, the solution that has been found consists in the fact that a) the screen roller has two coaxially mounted permeable screen roller jackets, at least in the area covered by the web of goods, said jackets being arranged with a distance between them;

b) a width-adjusting device is provided between the outer and inner screen roller jackets, which c) can be adjusted by a spindle on the axis of the screen roller, and d) the inner screen roller jacket is made permeable only in the area that corresponds to the minimum working width of the roller.

This produces a simple and consequently economical design that meets all the conditions for uniform processing of webs of goods of any working width. The double screen roller jacket ensures a powerful throttling of the through flow speed and thus results in a uniform impact on the web of goods by the air over its width. This problem is especially pertinent for large working widths and small screen roller diameters. It is further intensified if a fan is to be mounted on only one end of the roller. If the working width adjustment controllable by the axis is located in simple fashion between the two screen roller jackets, this design is optimum for any width of a web of goods.

The web of goods guided around the screen roller covers only a portion of its circumference. The size of this portion depends on whether only one roller is to be used, because then a larger percentage of the circumference can be utilized, or whether a plurality of rollers is to be used, arranged in series in a row for example, when only a maximum of 50 percent of the circumference of the roller is covered by the web of goods. The area of the screen roller that is not covered is blocked to prevent through flow from the inside. An especially advantageous design is obtained if the inner coaxially mounted permeable screen roller jacket is connected with the inner covering and therefore the inner screen roller jacket is mounted nonrotatably and the outer screen roller jacket that supports the web of goods is rotatable around the inner screen roller jacket.

This design can be obtained advantageously in many ways. The width adjustment then consists of only one bottom, and with a centrally organized application of the web of goods to the roller, consists of two annular radially aligned bottoms which are connected by arms with the axial mount of the roller. Since the inner screen roller jacket is mounted nonrotatably, each of the bottoms need extend only over the through-flow area of the roller, so that two arms suffice to mount the bottom.

BRIEF DESCRIPTION OF THE DRAWINGS

A device of the type according to the species is shown for example in the drawing. Further inventive details of the device will be explained with reference to the drawing.

DETAILED DESCRIPTION OF THE PREFERRED EMBODIMENTS

Figure 1:
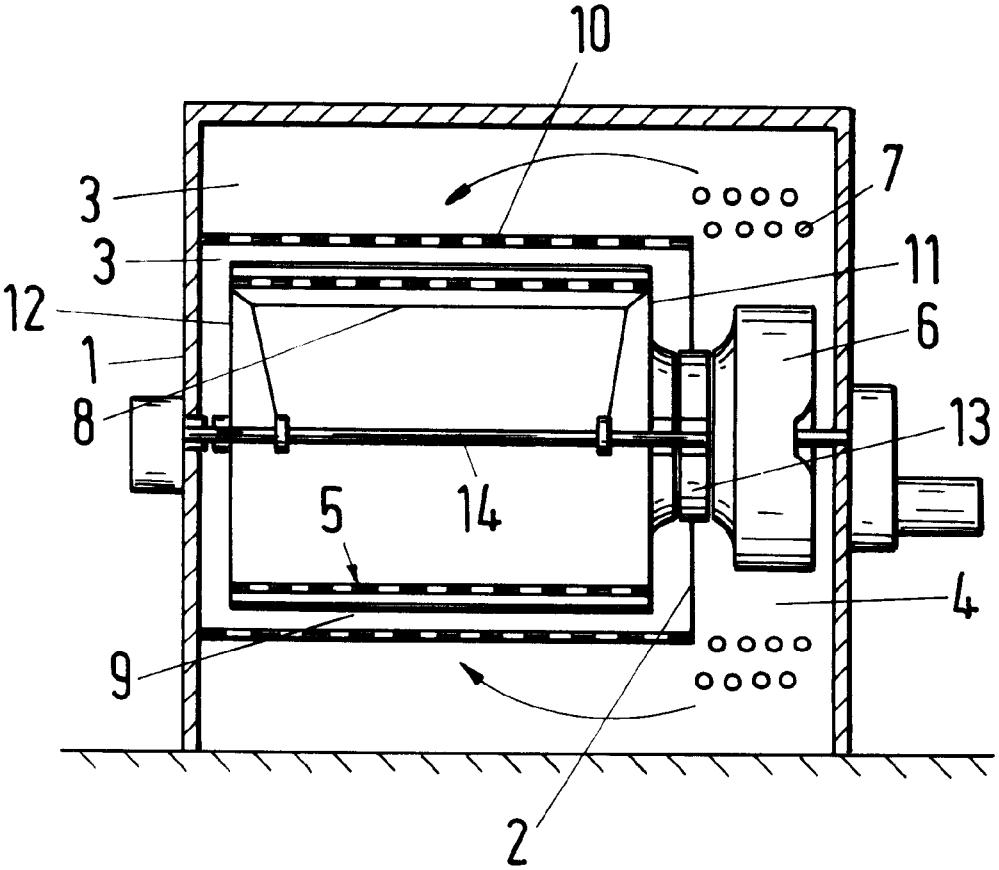
FIG. 1 is a section along a conventional screen roller device whose jacket consists of a perforated sheet metal roller with screen fabric stretched radially externally over it.

A screen roller device basically consists of an approximately rectangular housing 1 divided by a partition 2 into a processing chamber 3 and a fan chamber 4. Screen roller 5 and a fan 6, arranged concentrically to the screen roller in the fan chamber 4 downstream from a nozzle star 13, are rotatably mounted in processing chamber 3. Of course, the fan chamber can also be located in a separate fan housing that is separate from screen roller housing 1, not shown here. In any case, the fan evacuates the interior of roller 5. According to FIG. 1, heating assemblies 7 are located above and below fan 6, said assemblies consisting of tubes traversed by a heating medium. Above and below screen roller 5 a blocking lid 10 is located in processing chamber 3, said lid being intended to block and hence to distribute the air upstream of roller 5 coming from fan 6, uniformly over the working width. In the area not covered by the fabric, the screen roller is covered internally by an internal covering 8 held against axle 14, to block suction. Roller 5 is wrapped externally by a fine-mesh screen 9 that is held and tensioned at the end of the roller at both bottoms 11,12 by means of rings, not shown.

Figure 2:
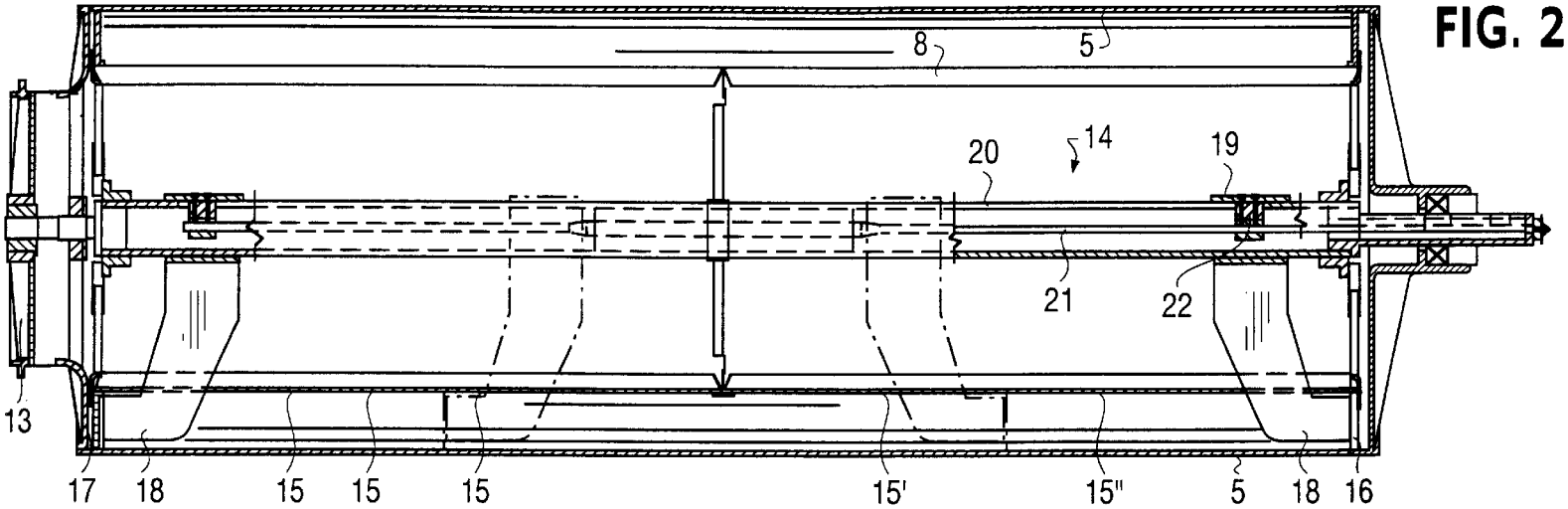
FIG. 2 shows the screen roller according to the invention in a lengthwise section along section line II—II in FIG. 3 with two perforated sheet metal jackets through which the flow is to take place, mounted sequentially in the working area of the roller.

The previously known roller 5 according to FIG. 1 is modified in FIG. 2 according to the invention. Initially, the roller consists not only of a screen roller jacket but of two concentric jackets 5 and 15. Inner jacket 15 is located at a distance from the actual screen roller jacket 5 and is extended by inner covering 8 to form a complete cylinder. Inner covering 8 is usually mounted nonrotatably in roller 5 at axis 14 and screen roller jacket 5 rotates around this inner covering 8. In simple fashion, the circumferential angle of the inner screen roller jacket is covered by the web of goods only to the same extent as roller 5 and is fastened to the inner covering. Thus, roller 5 rotates around the inner screen roller jacket 15, 8.

Figure 3:
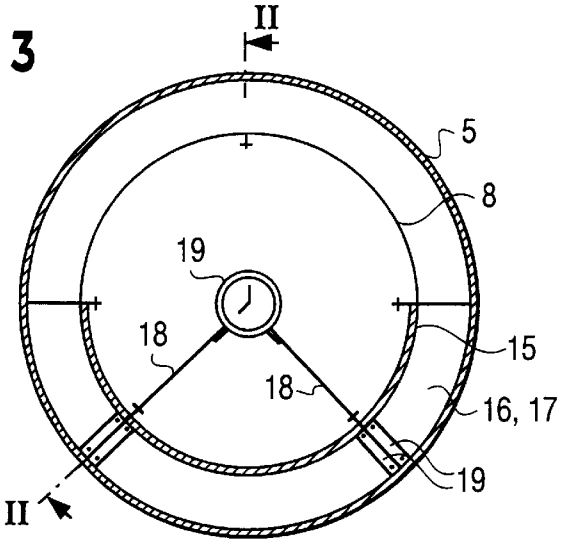
FIG. 3 shows a cross section through the roller according to FIG. 2.

A width-adjusting device is located between the two screen roller jackets 5 and 15 in the through-flow area of the roller 5. It consists of a radially aligned annular bottom 16 which, because of the central covering of the roller by the web of goods to be processed, is also provided on the other end of the roller with bottom 17. The size of the circular segments of bottoms 16, 17 corresponds to the coverage of the roller by the web of goods, in other words in this case according to FIG. 3, an angle of 180 degrees. As the inner screen roller jacket 15 is also perforated only over this angle, the flow through the goods takes place in area 15' while the remaining angle area is sealed by inner covering 8 against through flow. Bottoms 16, 17 are each secured by two arms 18 on axis 14 of roller 5.

Arms 18 are also radially directed, but they are cut off in the axial direction at the ends of roller 5, so that bottoms 16, 17 can be moved outward up to the outermost working width of roller 5. The inner screen roller jacket 15 is slotted lengthwise to allow arms 18 to pass through, at least in the area of the movement of the arms for adjusting the desired working width.

The inner screen roller jacket 15 is perforated only centrally, basically only in area 15' of the smallest adjustable working width, and the jacket surface is closed axially externally. According to FIG. 2, an additional area 15' can likewise be provided with a perforation, preferably with a smaller free cross section, in order to achieve a better through flow through a wider web of goods.

Arms 18 have bilateral flanges 19 at their radially outer ends for fastening arms 18 to bottoms 16, 17 and at their radially internal ends, an annular bearing shell 19 which surrounds a hollow shaft 20 that forms the roller axis 14. The bearing shell 19 and hence the arms 18 are therefore mounted axially displaceably on hollow shaft 20. The drive for displacing arms 18 is provided by a spindle 21 that is mounted rotatably on axis 14 and is driven externally. Spindle 21 is surrounded shapewise by a drive pin 22 which is permanently connected radially externally with bearing shell 19. In order to permit this displacement of bearing shell 19 and thus of bottoms 16, 17, hollow shaft 20 is slotted lengthwise in the area of displacement of bearing shell 19.

What is claimed is:

1. Device for heat treatment of permeable webs of goods, comprising a housing in which at least one screen roller is mounted and a pumping device is arranged endwise with respect to the roller, said device drawing a processing medium in the form of a vapor and/or gas out of the screen roller, with its through-flow area, in other words the working width of the screen roller, being capable of being determined by a width-adjusting device on the screen roller, characterized in that a) the screen roller has two coaxially mounted permeable screen roller jackets at least in the area covered by the web of goods, said jackets being mounted with a distance between them, b) a width-adjusting device is provided between the outer and inner screen roller jackets, which c) is adjustable by a spindle on the axis of the outer screen roller, and d) the inner screen roller jacket is made permeable only in the area that corresponds to the minimum working width of the roller.

2. Device according to claim 1, characterized in that the width-adjustment device consists of bottoms that are annular, located between the outer and inner screen roller jackets, and extend radially, said bottoms being connected by arms with the axial bearing of the roller outer screen.

3. Device according to claim 2 characterized in that the annular bottoms extend only over a ring segment, of the screen roller that is covered by the web of goods.

4. Device according to claim 2 characterized in that the axially mounted spindle is surrounded by a hollow shaft on whose outer circumference an annular bearing shell for the width-adjusting device for arms and hence for bottoms is axially displaceable.

5. Device according to claim 4, characterized in that the hollow shaft is slotted lengthwise in the area of the width-adjusting device and extends through a slot of a drive pin of the width-adjusting device that firstly surrounds the spindle and secondly is connected with the bearing shell.

6. Device with a non-rotatable inner covering to limit the through flow area relative to the circumferential angle of the screen roller, in accordance with claim 1, characterized in that the inner coaxially mounted permeable screen roller is connected with an inner covering, the inner screen roller jacket is mounted nonrotatably and the outer screen roller jacket that supports the web of goods is mounted to rotate around the inner screen roller jacket.

7. Device according to claim 6, characterized in that the inner permeable part of the screen roller jacket consists of only one circular segment and the remaining area of the full circle is formed by the remaining circular segment of the inner covering.

8. Device according to claim 6 characterized in that the width-adjusting device consists of bottoms that are annular, located between the outer and inner screen roller jackets, and extend radially, said bottoms being connected by arms with the axial bearing of the outer screen roller, and in that inner screen roller jacket in the area of the movement of the arms, is slotted in the axial direction to allow the arms of the width-adjusting device to pass through.

9. Device according to claim 8 characterized in that the air-permeable segment of the inner screen roller jacket is slotted in the area of movement of arms of the width-adjusting device in the axial direction to allow the arms to pass through.

10. Device according to claim 8, characterized in that the annular bottoms are provided between the permeable screen roller jackets at both ends of the outer screen roller so that the width adjustment is organized centrally.

11. Device according to claim 8, characterized in that the respective axially adjustable bottoms are secured by two or three on the roller axis.

12. Device according to claim 11 characterized in that the arms are aligned essentially radially over the area of the inner screen roller jacket, while in the area between the two jackets they are aligned axially outward to the ends of the outer screen roller.

13. Device according to claim 8, characterized in that the cross section of the air-permeable area of the inner the end of screen roller jacket that does not allow air to pass through is smaller than that of the outer screen jacket.

14. Device according to claim 13, characterized in that an additional permeable area is provided axially outside the air-permeable area of the inner screen jacket, with a free cross section that is even smaller by comparison with middle area.

15. Device according to claim 1, further comprising a screen lid located externally to the outer screen roller jacket for evening out the flow.

16. Device according to claim 1, further comprising a fixed cylindrical screen body located externally to the outer screen roller jacket for evening out the flow.

* * * * *